US005479663A

United States Patent [19]

Boyd

[11] Patent Number: 5,479,663

[45] Date of Patent: Jan. 2, 1996

[54] SAFETY LINER AND COVER ASSEMBLY FOR A WATER MATTRESS

[76] Inventor: Dennis Boyd, 14457 Rouge River, Chesterfield, Mo. 63017

[21] Appl. No.: 207,358

[22] Filed: Mar. 7, 1994

[51] Int. Cl.[6] ..... A47C 27/08

[52] U.S. Cl. ..... 5/470; 5/451; 5/473

[58] Field of Search ..... 5/451, 470, 473, 5/450, 451

[56] References Cited

U.S. PATENT DOCUMENTS

| | | | |
|---|---|---|---|
| 3,707,735 | 1/1973 | Carson, Jr. | 5/451 |
| 3,736,604 | 6/1973 | Carson, Jr. | 5/451 X |
| 4,145,780 | 3/1979 | Fogel | 5/350 |
| 4,149,286 | 4/1979 | Fogel | 5/370 |
| 4,173,049 | 11/1979 | Underwood et al. | 5/473 X |
| 4,186,455 | 2/1980 | Fox, Jr. et al. | 5/451 |
| 4,187,566 | 2/1980 | Peterson | 5/451 |
| 4,224,706 | 9/1980 | Young et al. | 5/449 |
| 4,301,561 | 11/1981 | McLeod | 5/496 |
| 4,489,453 | 12/1984 | Blaas et al. | 5/451 |
| 4,686,721 | 8/1987 | Hubert | 5/451 |
| 4,737,998 | 4/1988 | Johnson | 5/422 |
| 4,970,743 | 11/1990 | Wride et al. | 5/451 |
| 5,092,006 | 3/1992 | Fogel | 5/473 X |
| 5,144,707 | 9/1992 | Callaway et al. | 5/451 |
| 5,182,825 | 2/1993 | Stinson et al. | 5/451 |

*Primary Examiner*—Michael F. Trettel
*Attorney, Agent, or Firm*—Polster, Lieder, Woodruff & Lucchesi

[57] ABSTRACT

A safety liner and cover assembly for a water mattress disposed inside an external frame. The assembly includes a base composed of a sheet of flat vinyl material and a side wall extending circumferentially around the base to define a recess for receiving a water mattress. The side wall includes a layer of vinyl material sealed to the base such that the base and side wall form a watertight safety liner. The side wall also includes either a plurality of semi-rigid panels or a layer of fabric secured to the vinyl layer. The fabric layer is disposed exteriorly of the vinyl layer such that the fabric layer forms the external layer of the side wall. A top fabric panel is disposed above the recess and has a length and width comparable to the length and width of the base. A slide fastener is provided for removably securing the top fabric panel to the side wall around the perimeter of the side wall to enclose the recess defined by the side wall and the base.

11 Claims, 2 Drawing Sheets

SAFETY LINER AND COVER ASSEMBLY FOR A WATER MATTRESS

BACKGROUND OF THE INVENTION

This invention relates to waterbeds having a rigid external frame, and more particularly to a combination safety liner and cover assembly for such waterbeds.

Waterbed mattresses are known to provide many advantages in terms of comfort and restfulness. Since these mattresses are filled with water, some jurisdictions require that a safety liner be disposed about the mattress to contain any water which might spill out of the mattress in the event of a leak. These liners are typically formed of sheet vinyl, which presents a less than desirable appearance.

Waterbeds come in two basic types, soft side and rigid external frame. The soft side waterbeds more closely resemble conventional mattresses, but some people prefer the feel and comfort available only from a water mattress disposed in a rigid external frame. These frames, typically made of wood, customarily provide a place of attachment for the safety liner. On occasion, however, the safety liner can become partially detached from the external frame, which can be an annoyance to the user.

Water mattress typically are formed from an envelope of sheet vinyl material which contains the water. (Alternatively, a plurality of vinyl tubes can be used to contain the water.) Vinyl material is less pleasing to the body than fabric, so some people find the feel of water mattresses objectionable, even though the mattress is covered with sheets, blankets, etc. A cover for the water mattress is, therefore, considered a desirable feature by many users, although this does require means for holding the cover in place, and additional cost. A mattress cover, if suitably designed, can also have the advantageous effect of reducing heat loss from the water mattress. Since many waterbeds include heaters to keep the water in the mattress at a constant temperature, a cover can also result in reduced energy consumption because of the reduced heat loss. In some instances, a suitably designed cover can make a heater for the water mattress unnecessary.

SUMMARY OF THE INVENTION

Among the various objects and features of the present invention may be noted the provision of an improved cover and safety liner for a water mattress.

Another object is the provision of such a cover and safety liner with an improved appearance.

A third object is the provision of such a cover and safety liner specifically designed by use with an external rigid frame which requires no connection to the frame.

A fourth object is the provision of such a cover and safety liner in which the cover is removably secured to the safety liner.

A fifth object is the provision of such a cover and safety liner in which the safety liner is an integral and necessary part of the cover.

A sixth object is the provision of such a cover and safety liner which results in reduced energy costs.

A seventh object is the provision of such a cover and safety liner which has improved comfort and aesthetics.

An eighth object is the provision of such a cover and safety liner which reduces or eliminates the need for a heater for the water mattress.

Other objects and features will be in part apparent and in part pointed out hereinafter.

Briefly, in a first aspect of the a safety liner and cover assembly of the present invention is suitable for a water mattress disposed inside an external frame. The safety liner and cover assembly includes a base composed of a sheet of flat vinyl material, and a side wall extending circumferentially around the base to define a recess for receiving a water mattress. The side wall includes a layer of vinyl material sealed to the base such that the base and side wall form a watertight safety liner. The side wall further includes a layer of fabric secured to the layer of vinyl and disposed exteriorly thereof such that the fabric layer forms the external layer of the side wall. A top fabric panel is disposed above the recess and has a length and width comparable to the length and width of the base. A mechanism is provided for removably securing the top fabric panel to the side wall around the perimeter of the side wall to enclose the recess defined by the side wall and the base.

In a second aspect of the present invention, the safety liner and cover assembly for a water mattress adapted to be disposed inside an external frame includes a base composed of a sheet of fiat vinyl material and a side wall extending circumferentially around the base to define a recess for receiving a water mattress. The side wall includes a layer of vinyl material sealed to the base such that the base and side wall form a watertight safety liner. The side wall further includes a plurality of semi-rigid panels secured to the vinyl layer. A top fabric panel is disposed above the recess and has a length and width comparable to the length and width of the base. A mechanism is provided for removably securing the top fabric panel to the side wall around the perimeter of the side wall to enclose the recess defined by the side wall and the base.

In a third aspect of the present invention, a waterbed includes an external rigid frame sized to receive and support a water mattress, a water mattress, and a safety liner and cover assembly sized to fit within the external rigid frame and to completely surround the water mattress. The safety liner and cover assembly includes a base composed of a sheet of fiat vinyl material and a side wall extending circumferentially around the base to define a recess for receiving the water mattress. The side wall includes a layer of vinyl material sealed to the base such that the base and side wall form a watertight safety liner. The safety liner and cover assembly also includes a top fabric panel disposed above the recess and having a length and width comparable to the length and width of the base, and a mechanism for removably securing the top/fabric panel to the side wall around the perimeter of the side wall to enclose the water mattress in the recess defined by the side wall and the base.

BRIEF DESCRIPTION OF THE DRAWINGS

Similar reference characters indicate similar parts throughout the several views of the drawings.

DESCRIPTION OF THE PREFERRED EMBODIMENTS

Figure 1:
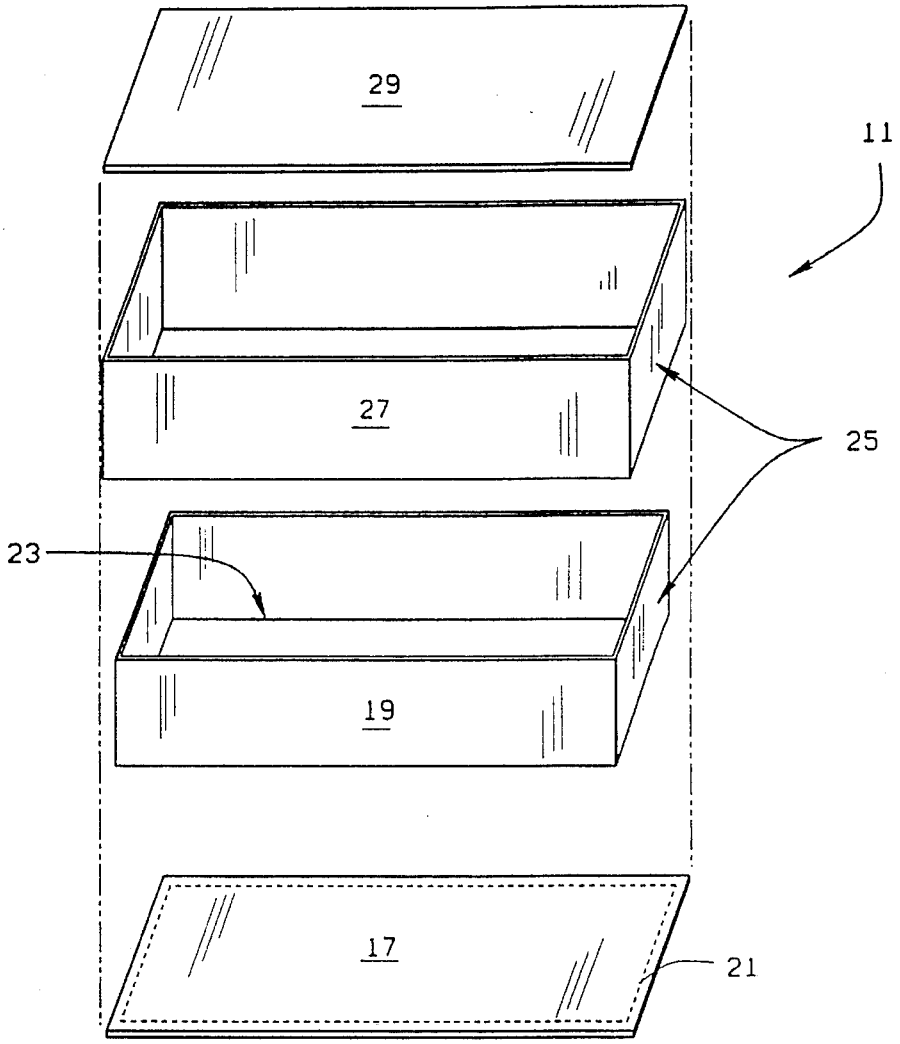
FIG. 1 is an exploded view illustrating the various major components of a first embodiment of the safety liner and cover assembly of the present invention.
Figure 2:
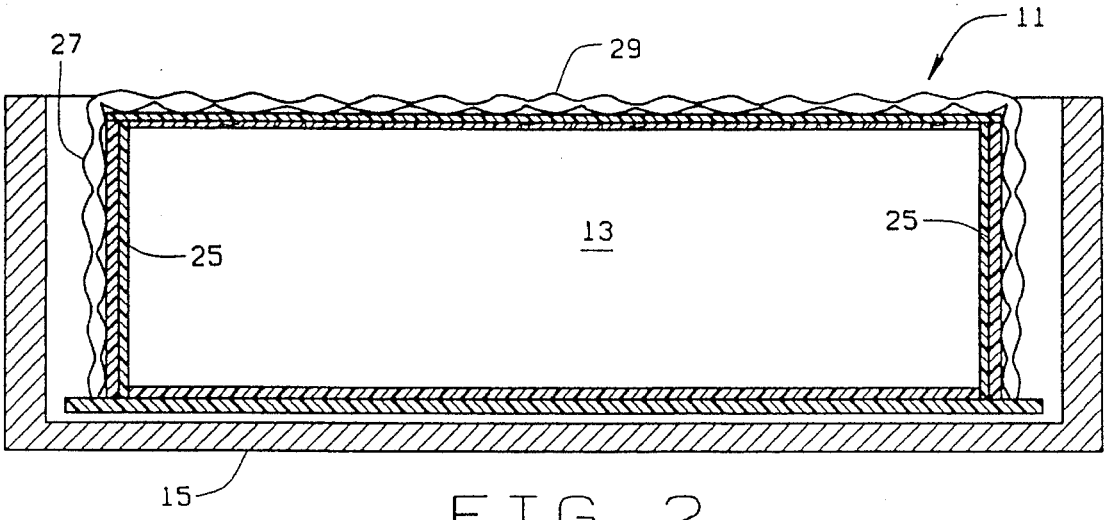
FIG. 2 is a front elevation, with parts removed for clarity, of a safety liner and cover assembly of the present invention disposed around a water mattress and disposed in a rigid external waterbed frame.

Turning now to the drawings, and specifically to FIGS. 1 and 2, a safety liner and cover assembly 11 is designed to fully enclose a water mattress 13 of the type typically disposed inside an external frame 15. Frame 15 is made of wood or other suitable material. In FIG. 2 the spacing between the various components of the waterbed are shown in exaggerated fashion for clarity of illustration. It should be understood that in actuality the water mattress 13 presses closely against assembly 11 and that assembly 11 in turn presses closely against wooden frame 15. The actual construction of safety liner and cover assembly 11 in FIG. 2 is also simplified for purposes of illustration.

As can best be seen in FIG. 1, assembly 11 includes a base 17 composed of a sheet of flat vinyl material such as the material conventionally used for safety liners. A layer of vinyl 19 is suitably secured to base 17 by heat sealing or the like to form a watertight seal. The base 17 includes a flange 21 which extends around the periphery of the base and is indicated by the dashed lines in FIG. 1. Vinyl layer 19 is heat sealed to this flange, and other connections are made thereto as described below. The central portion of base 17 is sized to receive water mattress 13, and the vinyl layer in combination with the base defines a recess 23 for receiving the water mattress.

Figure 3:
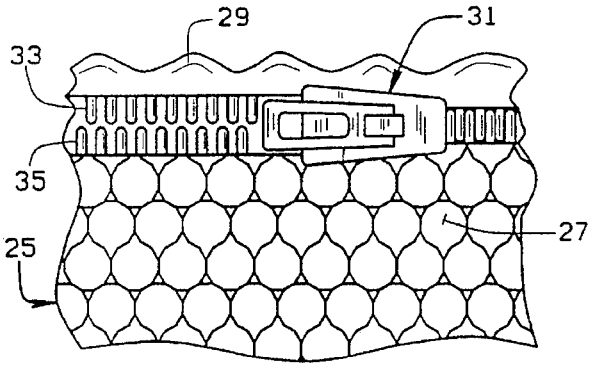
FIG. 3 is a front elevation of a portion of the safety liner and cover assembly of the present invention illustrating the connection between the top and the sides of the assembly.

Vinyl layer 19 is one portion of a side wall 25 which extends circumferentially around base 17. Side wall 25 further includes a layer of fabric 27 secured to vinyl layer 19 as described below in connection with FIG. 4. The fabric layer is disposed exteriorly of the vinyl layer so that fabric layer 27 forms the external surface of side wall 25. As best seen in FIGS. 2 and 3, fabric layer 27 is preferably quilted to provide the appearance of a conventional mattress cover.

The safety liner and cover assembly also includes a top fabric panel 29 disposed above recess 23. Panel 29 is sized to fill the space above recess 23 and, therefore, has a length and width comparable to the length and width of base 17. Although shown unadorned in FIG. 1, it is preferred that top panel 29 be a quilted ticking as shown in FIGS. 2 and 3. By suitable selection of the material forming top panel 29, it is possible to eliminate the need for a heater for the water mattress, which eliminates the energy consumption normally associated with a water mattress of this type. Of course, a cover with lesser insulative properties still functions to substantially reduce energy consumption.

A slide fastener 31 having a first set of teeth 33 connected to top panel 29 and a second set of teeth 35 connected to side wall 25 extends around the assembly to permit removable connection of the top panel from the side wall. (See FIG. 3). It should be understood that top panel can be at least partially removed from side wall 25 to allow access to recess 23 and in particular to water mattress 13 therein. Thereafter, the slide fastener can be used to completely enclose the mattress in liner and cover assembly 11. Teeth 35, therefore, constitute first fastening means secured to a portion of the fabric layer of the side wall and teeth 33 constitute second fastening means, matingly engageable with the first fastening means, secured to the top fabric panel around the periphery thereof.

Figure 4:
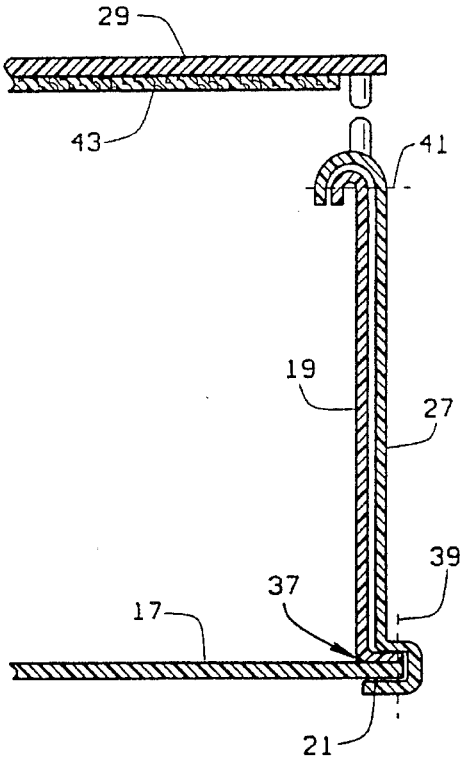
FIG. 4 is a sectional view illustrating the construction of the safety liner and cover assembly of the present invention.

Turning to FIG. 4, it can be seen that side wall vinyl layer 19 is heated sealed as indicated at 37 to base 17. The bottom end of side wall fabric layer 27 (shown unquilted in FIG. 4 for clarity of illustration) is disposed over flange 21 and is fixedly secured thereto as by sewing or the like (as indicated by the line 39). It should be appreciated that sewing fabric layer 27 to flange 21 can also result in the fabric layer being sewn to side wall vinyl layer 19 as well. Other methods of attachment could, of course, also be used.

The top of side wall vinyl layer may be folded over as shown or remain straight. The top of side wall fabric layer 27 is folded over the uppermost portion of the vinyl layer 19 and the two layers are fixedly securing together, such as by sewing, as indicated by line 41. Thus, fabric layer 27 and vinyl layer 19 are preferably secured together (either directly or indirectly) at both the top and bottom of the side wall. It is preferred that the two layers be secured together completely around the periphery (i.e., the entire extent) of the assembly 11.

As can best be seen in FIG. 4, top fabric panel 29 preferably has attached thereto a top vinyl panel 43 secured to the top fabric panel such that the top vinyl panel is exposed to recess 23 and the top fabric panel forms the exterior of the composite top panel. The top vinyl panel 43 results in the entire recess being substantially enclosed by vinyl.

Figure 5:
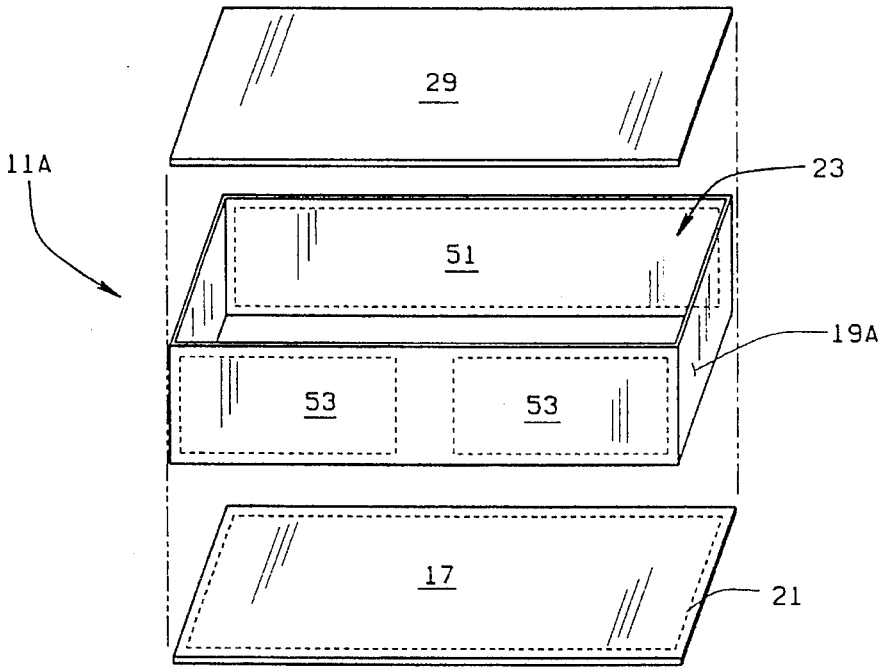
FIG. 5 is an exploded view similar to FIG. 1 illustrating the major components of a second embodiment of the safety liner and cover assembly of the present invention.

Turning to FIG. 5, an alternative construction of the safety liner and cover assembly of the present invention, labeled 11A, is shown. In this construction, vinyl side wall panel 19A includes a plurality of cardboard or chipboard semi-rigid inserts 51, 53, therein to provide a standup liner. The precise number of insert panels 51, 53, and their placement is not a feature of the present invention. For example, a single insert 51 is shown on one side of recess 23, while a pair 53 are shown on the other side. Of course, a fabric side wall layer could be included in the construction of FIG. 5 as well. The various methods of attaching the various parts together discussed above in connection with FIGS. 1–4 could also be used with respect to the construction of FIG. 5. It is preferred, for example, that a slide fastener be used to removably secure side wall 19A to top panel 29 in the construction of FIG. 5. It is also preferred that the top fabric panel include a top vinyl panel secured thereto, as described above, and that the top fabric panel be a quilted ticking.

In view of the above, it will be seen that the various objects and features of the present invention are achieved and other advantageous results obtained. Numerous variations of the present invention are contemplated, so that the embodiments described herein are intended to be illustrative only and not to be taken in a limiting sense.

What is claimed is:

1. A safety liner and cover assembly for a water mattress adapted to be disposed inside an external frame comprising:

a base composed of a sheet of fiat vinyl material;

a side wall extending circumferentially around the base to define a recess for receiving a water mattress, said side wall including a layer of vinyl material sealed to the base such that the base and side wall form a watertight safety liner, said side wall further including a layer of fabric secured to said layer of vinyl and disposed exteriorly thereof such that the fabric layer forms the external layer of the side wall;

a top fabric panel disposed above the recess and having a length and width comparable to the length and width of the base;

means for removably securing the top fabric panel to the side wall around the perimeter of the side wall to enclose said recess defined by the side wall and the base.

2. The safety liner and cover assembly for a water mattress as set forth in claim 1 wherein said vinyl sheet has a central portion sized to receive the water mattress and a flange portion extending circumferentially around the central portion and being integral therewith.

3. The safety liner and cover assembly for a water mattress as set forth in claim 2 wherein the fabric layer of the side wall is fixedly secured to the flange portion of the vinyl sheet.

4. The safety liner and cover assembly for a water mattress as set forth in claim 3 wherein the fabric layer of the side wall is fixedly secured to the vinyl layer of the side wall adjacent the top of the side wall.

5. The safety liner and cover assembly for a water mattress as set forth in claim 1 wherein the means for removably securing the top fabric panel to the side wall includes first fastening means secured to a portion of the fabric layer of the side wall and second fastening means, matingly engageable with the first fastening means, secured to the top fabric panel around the periphery thereof.

6. The safety liner and cover assembly for a water mattress as set forth in claim 1 further including a top vinyl panel secured to the top fabric panel such that the top vinyl panel is exposed to the recess and the top fabric panel forms the exterior of the top panel.

7. The safety liner and cover assembly for a water mattress as set forth in claim 1 wherein the top of the side wall fabric layer is fixedly secured along substantially the entire extent thereof to the top of the side wall vinyl layer.

8. The safety liner and cover assembly for a water mattress as set forth in claim 1 wherein the top fabric panel is a quilted ticking.

9. The safety liner and cover assembly for a water mattress as set forth in claim 1 wherein the means for removably securing the top fabric panel to the side wall is a slide fastener.

10. A safety liner and cover assembly for a water mattress adapted to be disposed inside an external frame comprising:

a base composed of a sheet of fiat vinyl material:

a side wall extending circumferentially around the base to define a recess for receiving a water mattress, said side wall including a layer of vinyl material sealed to the base such that the base and side wall form a watertight safety liner, said side wall further including a plurality of semi-rigid panels secured to said vinyl layer, said semi-rigid panels being formed from a material selected from the group consisting essentially of cardboard and chipboard:

a top/fabric panel disposed above the recess and having a length and width comparable to the length and width of the base;

means for removably securing the lop fabric panel to the side wall around the perimeter of the side wall to enclose said recess defined by the side wall and the base:

further including a top vinyl panel secured to the top fabric panel such that the top vinyl panel is exposed to the recess and the top fabric panel forms the exterior of the top panel.

11. A waterbed comprising:

an external rigid frame sized to receive and support a water mattress;

a water mattress;

a safety liner and cover assembly sized to fit within said external rigid frame and to completely surround the water mattress;

said safety liner and cover assembly including;

a base composed of a sheet of flat vinyl material;

a side wall extending circumferentially around the base to define a recess for receiving the water mattress, said side wall including a layer of vinyl material sealed to the base such that the base and side wall form a watertight safety liner;

a top fabric panel disposed above the recess and having a length and width comparable to the length and width of the base;

means for removably securing the top fabric panel to the side wall around the perimeter of the side wall to enclose the water mattress in said recess defined by the side wall and the base;

said side wall of the safety liner and cover assembly including a layer of fabric secured to the side wall vinyl layer and disposed exteriorly thereof such that the fabric layer forms the external layer of the side wall.

* * * * *